US008269681B2

(12) United States Patent
Yang et al.

(10) Patent No.: US 8,269,681 B2
(45) Date of Patent: Sep. 18, 2012

(54) SHEET-LIKE DIPOLE ANTENNA

(75) Inventors: Tsai-Yi Yang, Tainan Hsien (TW); Wei-Hung Hsu, Tainan Hsien (TW)

(73) Assignee: Cirocomm Technology Corp., Tainan Hsien (TW)

( * ) Notice: Subject to any disclaimer, the term of this patent is extended or adjusted under 35 U.S.C. 154(b) by 516 days.

(21) Appl. No.: 12/651,587

(22) Filed: Jan. 4, 2010

(65) Prior Publication Data

US 2011/0163929 A1 Jul. 7, 2011

(51) Int. Cl.
*H01Q 13/10* (2006.01)
*H01Q 9/28* (2006.01)
*H01Q 21/00* (2006.01)

(52) U.S. Cl. ..... 343/725; 343/767; 343/795

(58) Field of Classification Search ..... 343/767, 343/793, 795, 725
See application file for complete search history.

(56) References Cited

U.S. PATENT DOCUMENTS 7,932,863 B2 * 4/2011 Pros et al. ..... 343/702
8,106,836 B2 * 1/2012 Hill et al. ..... 343/702

* cited by examiner

*Primary Examiner* — Jacob Y Choi
*Assistant Examiner* — Hasan Islam
(74) *Attorney, Agent, or Firm* — Chun-Ming Shih; HDLS IPR Services

(57) ABSTRACT

A sheet-like dipole antenna includes a substrate (1), an F-shape antenna (2), and a cable (3). The substrate (1) has a copper clad surface (11) and a slot (12). An insulating film (13) is provided on the copper clad surface (11) and the slot (12). A first soldering region (14), a second soldering region (15), and a third soldering region (16) are positioned adjacent to the slot (12). The cable (3) has a core (31) coated with an insulating layer (32). The insulating layer (32) is coated with a grounding layer (33). The grounding layer (33) is coated with an outer skin (34). One end of the cable (3) is electrically connected to a connector (35). The core (31) is connected to the second soldering region (15). The grounding layer (33) is soldered to the third soldering region (16).

7 Claims, 15 Drawing Sheets

SHEET-LIKE DIPOLE ANTENNA

BACKGROUND OF THE INVENTION

1. Field of the Invention

The present invention relates to an antenna, in particular, a sheet-like dipole antenna.

2. Description of Prior Art

The size of a common microwave antenna is half of the wavelength (2/λ) according to its resonance frequency, such a microwave antenna includes a dipole antenna or a micro-strip patch antenna.

In order to further improve the miniaturization of antenna, a planar inverted-F antenna (PIFA) has been developed recently, in which the operating length of the antenna is reduced to only one-fourth of the wavelength (4/λ), thereby reducing the area occupied by the antenna greatly. On the other hand, since the planar antenna has a low profile, an embedded antenna can be achieved.

Recently, light-emitting diodes (LED) have been used in lamps and other electronic products, and even, used in backlight modules of new-generation notebook computers as a light source. Since the LED module is used as a backlight source in a display screen of the computer, the space for the antenna adjacent to the LED module has been reduced. As a result, the conventional antenna used in a notebook computer has become unfeasible for the latest notebook computer.

SUMMARY OF THE INVENTION

The present invention is to solve the problems in conventional art. The present invention provides a high-efficiency embedded antenna or sheet-like pointing GPS antenna used in a wireless local area network (wireless LAN), and a high-efficiency dipole antenna formed by using a medium of high dielectric constant as a signal input means.

The present invention is to provide a sheet-like dipole antenna, mounted within an electronic product and including the following items:

a substrate having a copper clad surface, the copper clad surface having a slot constituted of a short-strip section, a rectangular section, and a long-strip section, an insulating film being provided on the copper clad surface and the slot, a rectangular first soldering region uncovered by the insulating film being formed on the copper clad surface in front and rear of the rectangular section of the slot respectively, a squared second soldering region uncovered by the insulating film being formed on the copper clad surface to connect to one side of the first soldering region, one side of the second soldering region being connected to the long-strip section of the slot, a square third soldering region uncovered by the insulating film being formed on the copper clad surface to connect to the other side of the long-strip section of the slot;

an F-shape antenna which has a carrier, the top surface of the carrier having a radiation metallic surface, the radiation metallic surface having an input pin and a grounding short-circuit pin extending to one side of the carrier, the F-shape antenna being soldered to both of the first soldering regions with the input pin electrically connected to the second soldering region;

a cable with a core which is coated by an insulating layer, the insulating layer being coated by a grounding layer, the grounding layer being coated by an outer skin, one end of the cable being electrically connected to a connector, the core being connected to the second soldering region, the grounding layer being soldered to the third soldering region.

DETAILED DESCRIPTION OF THE INVENTION

The characteristics and technical contents of the present invention will be described with reference to the accompanying drawings. However, the drawings are illustrative only but not used to limit the present invention.

Figure 1:
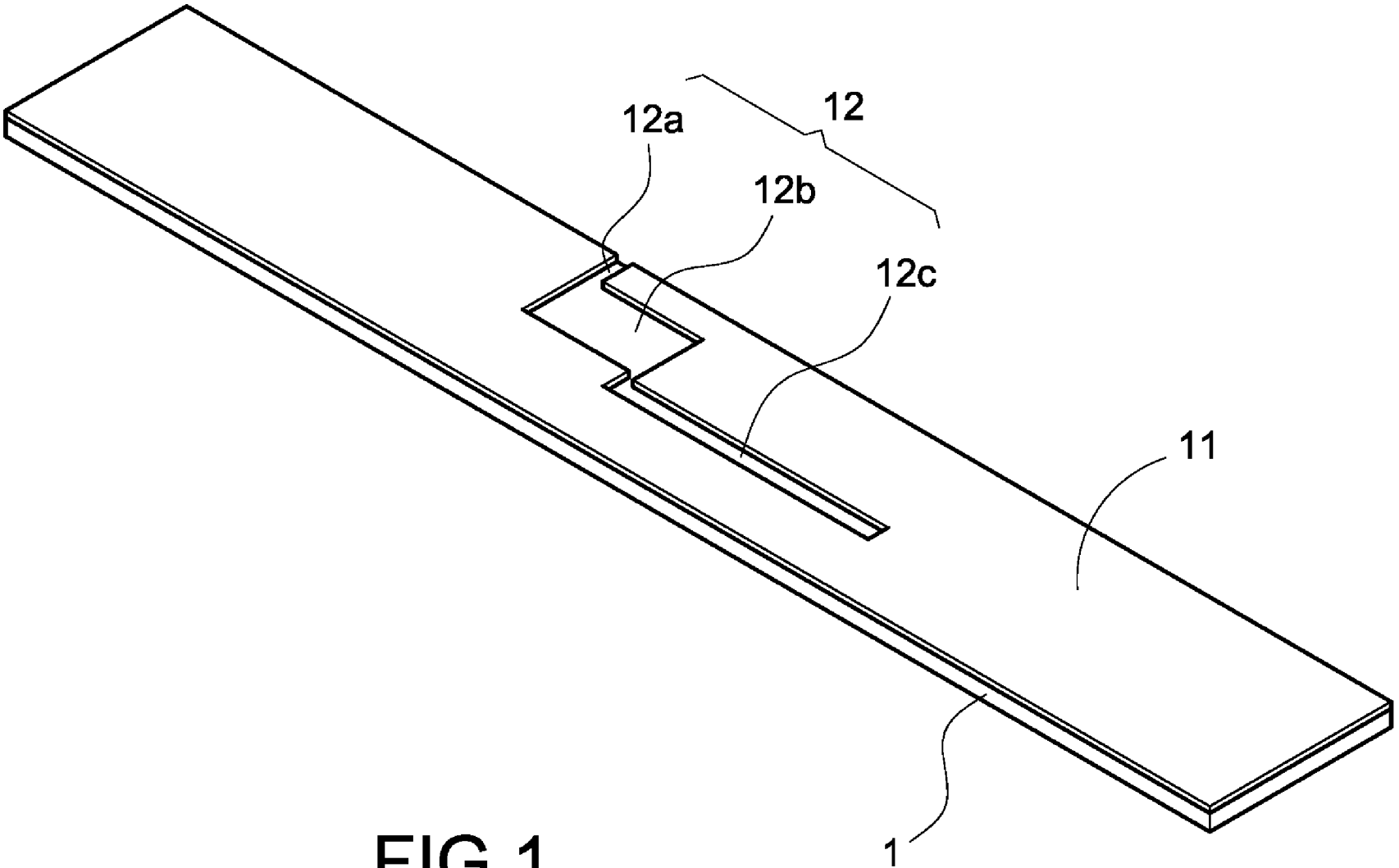
FIG. 1 is a schematic view (I) showing a substrate used in manufacturing a sheet-like dipole antenna of the present invention.
Figure 2:
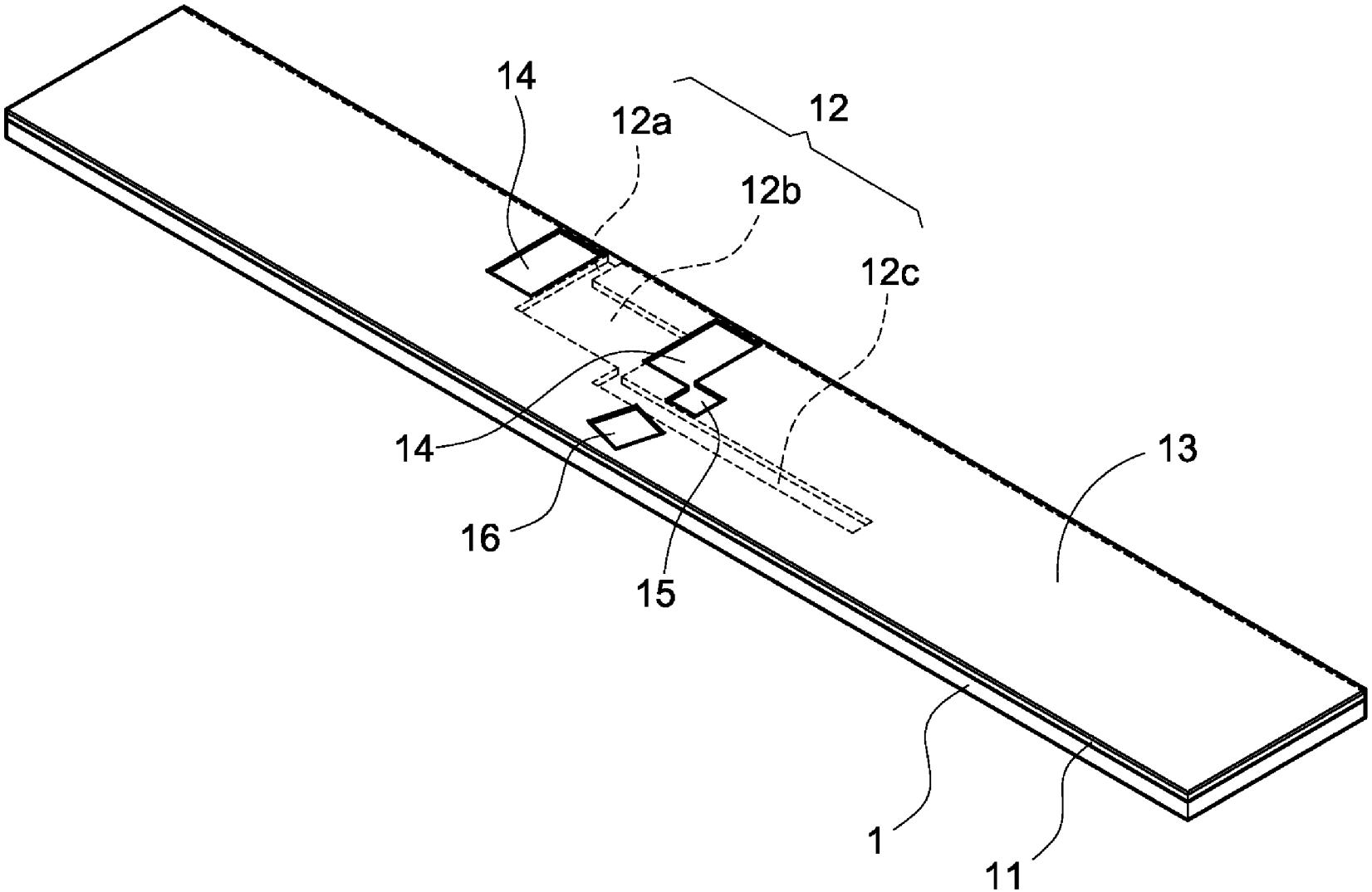
FIG. 2 is a schematic view (II) showing a substrate used in manufacturing a sheet-like dipole antenna of the present invention.

Please refer to FIGS. 1 and 2, which are schematic views (I) and (II) showing a substrate used in manufacturing a sheet-like dipole antenna of the present invention. As shown in these figures, substrate 1 used in manufacturing the sheet-like dipole antenna of the present invention has a copper clad surface (metallic patch) 11. The length L of the copper clad surface 11 is in a range from one-fourth to three-fourth of the wavelength (that is, $\lambda/4 \leqq L \leqq 3\lambda/4$), and its width W is larger than one-eighth of the wavelength (that is, $\lambda/8 < W$). The copper clad surface 11 is formed with a slot 12 constituted of a short-strip section 12*a*, a rectangular section 12*b* and a long-strip section 12*c*.

After the copper clad surface 11 and the slot 12 are formed, the copper clad surface 11 is coated with insulating paint (glue) to form an insulating film (anti-soldering region) 13. A rectangular first soldering region 14 uncovered by the insulating film 13 is formed on the copper clad surface 11 in front and rear of the rectangular section 12*b* of the slot 12 respectively. The first soldering regions 14 are configured to be soldered with an F-shape antenna. A squared second soldering region 15 uncovered by the insulating film 13 is formed on the copper clad surface 11 to connect to one side of the first soldering region 14. One side of the second soldering region 15 is connected to the long-strip section 12*c* of the slot 12. A squared third soldering region 16 uncovered by the insulating film 13 is formed on the copper clad surface 11 to connect to the other side of the long-strip section 12*c* of the slot 12. The third soldering region 16 and the second soldering region 15 are located opposite to each other in a diagonal direction.

Figure 3:
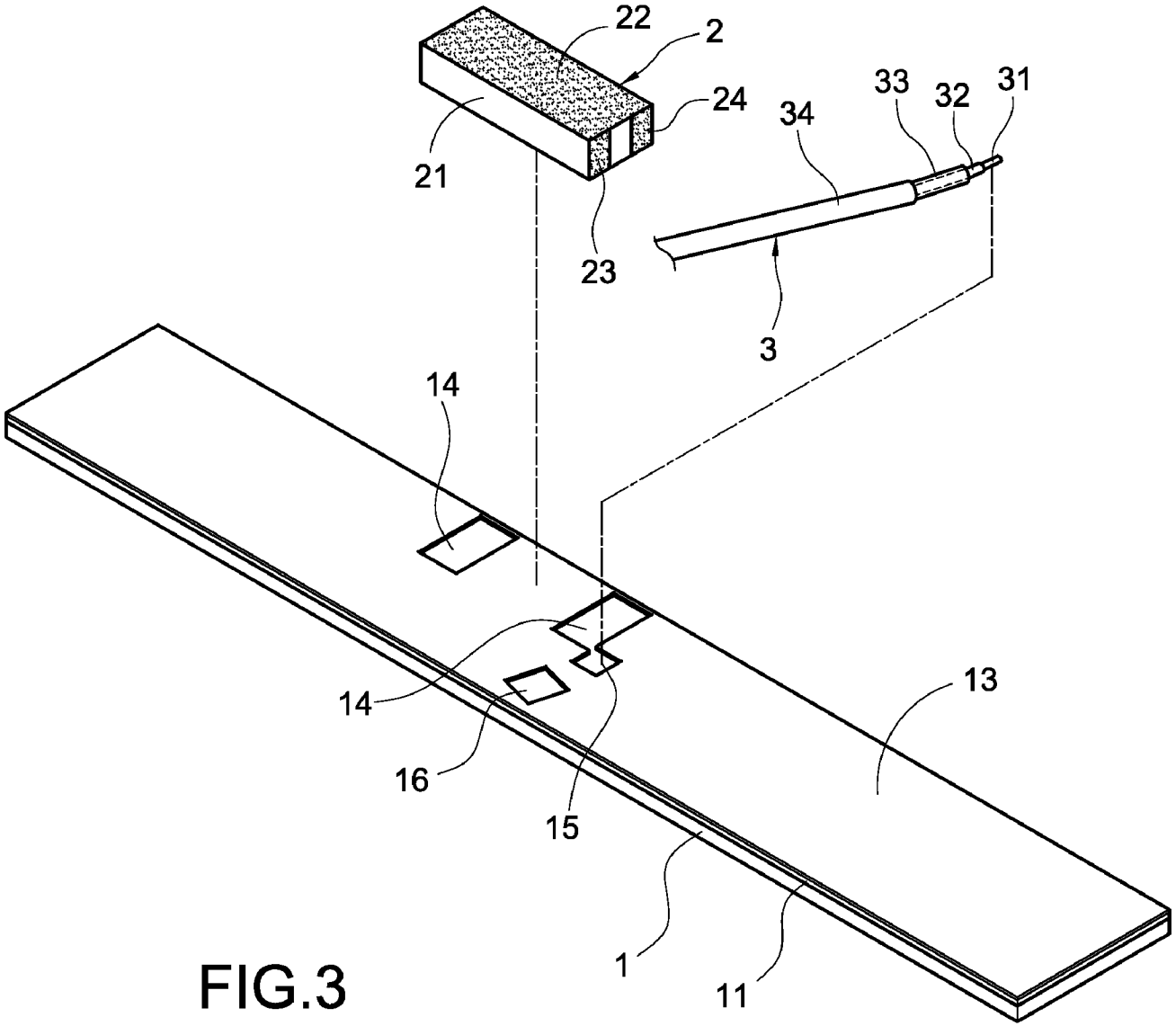
FIG. 3 is an exploded view showing the sheet-like dipole antenna of the present invention.
Figure 4:
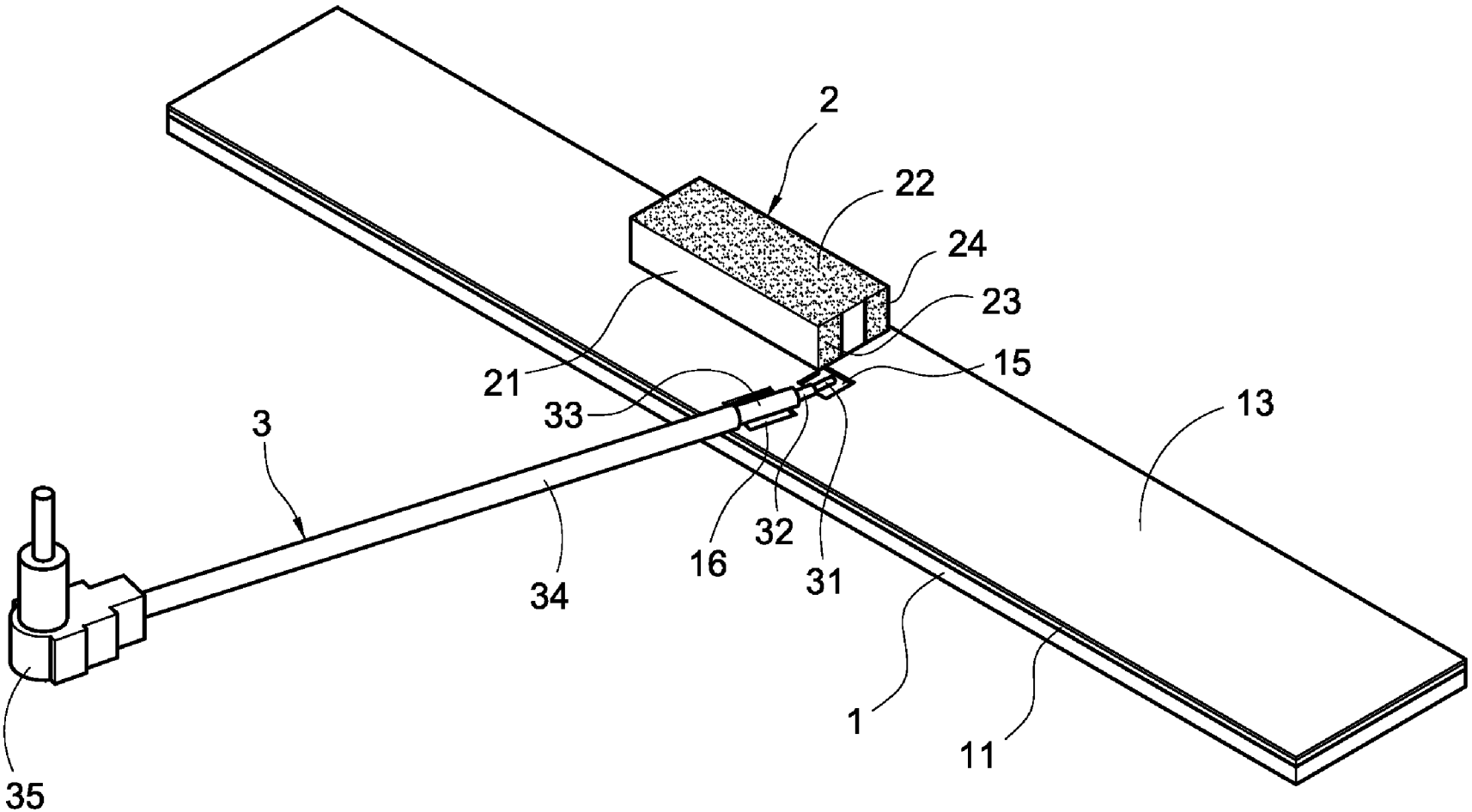
FIG. 4 is an assembled view showing the sheet-like dipole antenna of the present invention.

Please refer to FIGS. 3 and 4. FIG. 3 is an exploded view showing the sheet-like dipole antenna of the present invention, and FIG. 4 is an assembled view showing the sheet-like dipole antenna of the present invention. As shown in these figures, the sheet-like dipole antenna includes a substrate 1, an F-shape antenna 2, and a cable 3.

The substrate 1 is configured to have the structure as mentioned above. The F-shape antenna 2 has a carrier 21 made of high dielectric constant materials. Top surface of the carrier 21 has a radiation metallic surface 22. The radiation metallic surface 22 has an input pin 23 and a grounding short-circuit pin 24 extending to one side surface of the carrier 21. The F-shape antenna 2 is soldered to both of the first soldering regions 14 with the input pin 23 electrically connected to the second soldering region 15.

The cable 3 has a core 31. The core 31 is coated by an insulating layer 32. The insulating layer 32 is coated by a grounding layer 33. The grounding layer 33 is coated by an outer skin 34. One end of the cable 3 is electrically connected with a connector 35. The core 31 is connected to the second soldering region 15. The grounding layer 33 is soldered to the third soldering region 16. With this arrangement, the sheet-like dipole antenna can be completed.

After the connector 35 is assembled with an antenna insertion port (not shown) on a circuit board of an electronic product, and the radiation metallic surface 22 of the F-shape antenna 2 receives signals, the signals are transmitted from the input pin 23 to the core 31 of the cable 3, and then processed by the circuit board of the electronic product.

Figure 5:
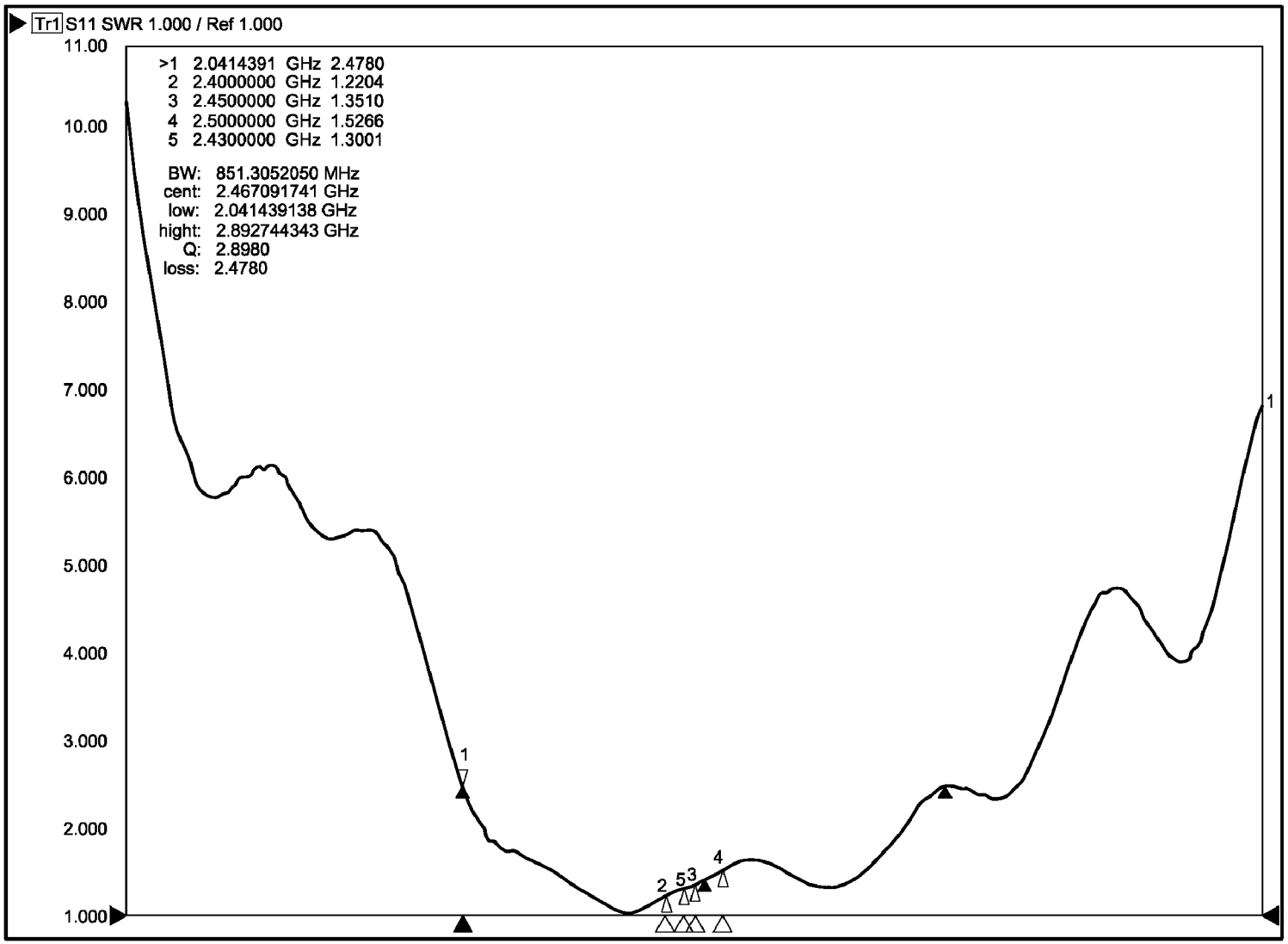
FIG. 5 is a view showing the VSWR (voltage standing wave ratio) of the sheet-like dipole antenna of the present invention.

Please refer to FIG. 5, which is a view showing the VSWR (voltage standing wave ratio) of the sheet-like dipole antenna of the present invention. As shown in this figure, the VSWR is 2.47 when the frequency is 2041 MHz, 1.22 when the frequency is 2400 MHz, 1.35 when the frequency is 2450 MHz, 1.52 when the frequency is 2500 MHz, and 1.30 when the frequency is 2430 MHz. Thus, the VSWR is always smaller than 3.5, which means that the antenna of the present invention is an ideal antenna.

Figure 6:
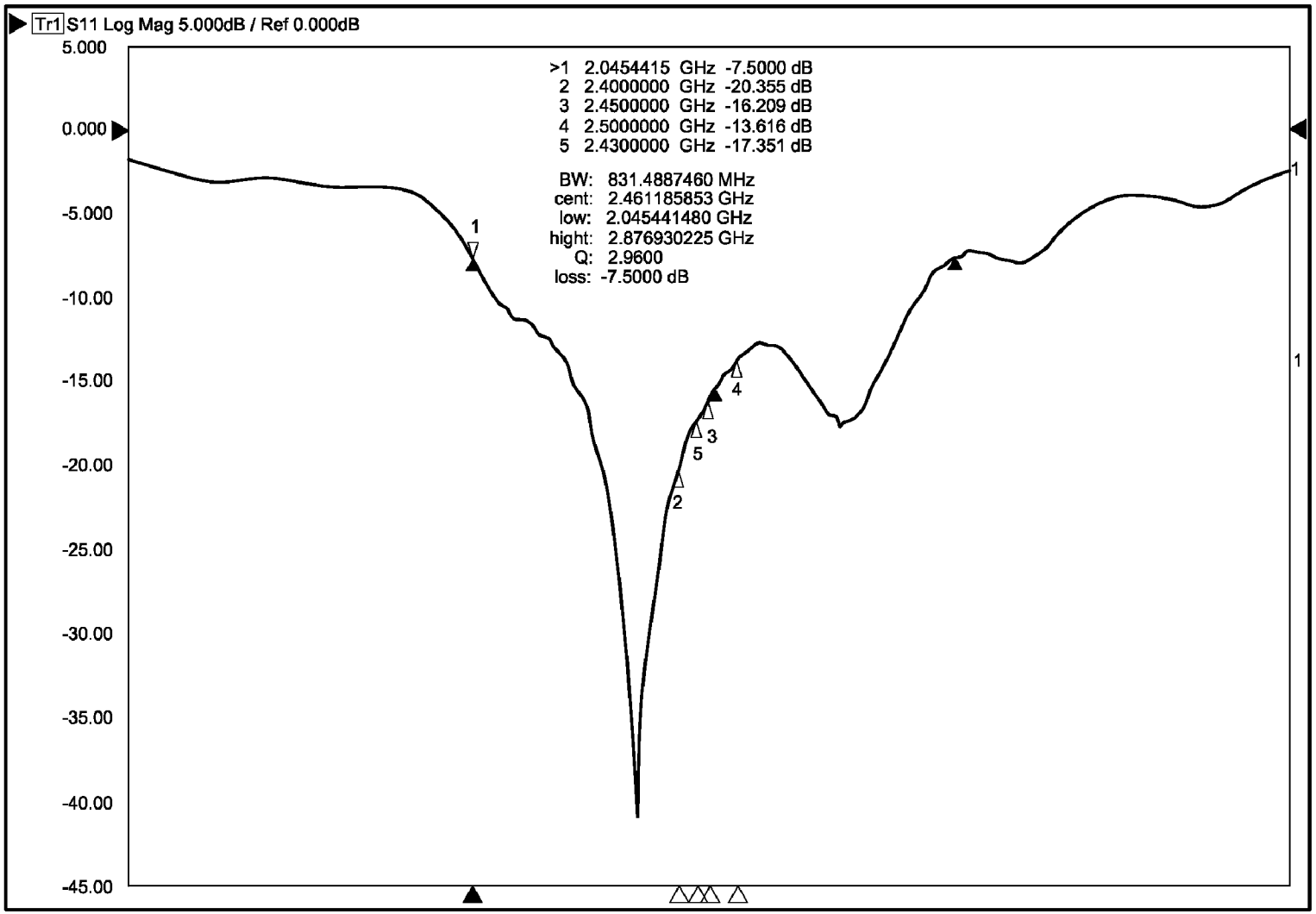
FIG. 6 is a view showing the return loss of the sheet-like dipole antenna of the present invention.

Please refer to FIG. 6, which is a view showing the return loss of the sheet-like dipole antenna of the present invention. As shown in this figure, the return loss is −7.50 dB when the frequency is 2045 MHz, −20.35 dB when the frequency is 2400 MHz, −16.20 dB when the frequency is 2450 MHz, −13.61 dB when the frequency is 2500 MHz, and −17.35 dB when the frequency is 2430 MHz. Thus, the return loss is always smaller than −5.0 dB, which means that the antenna of the present invention is an ideal antenna.

Figure 7:
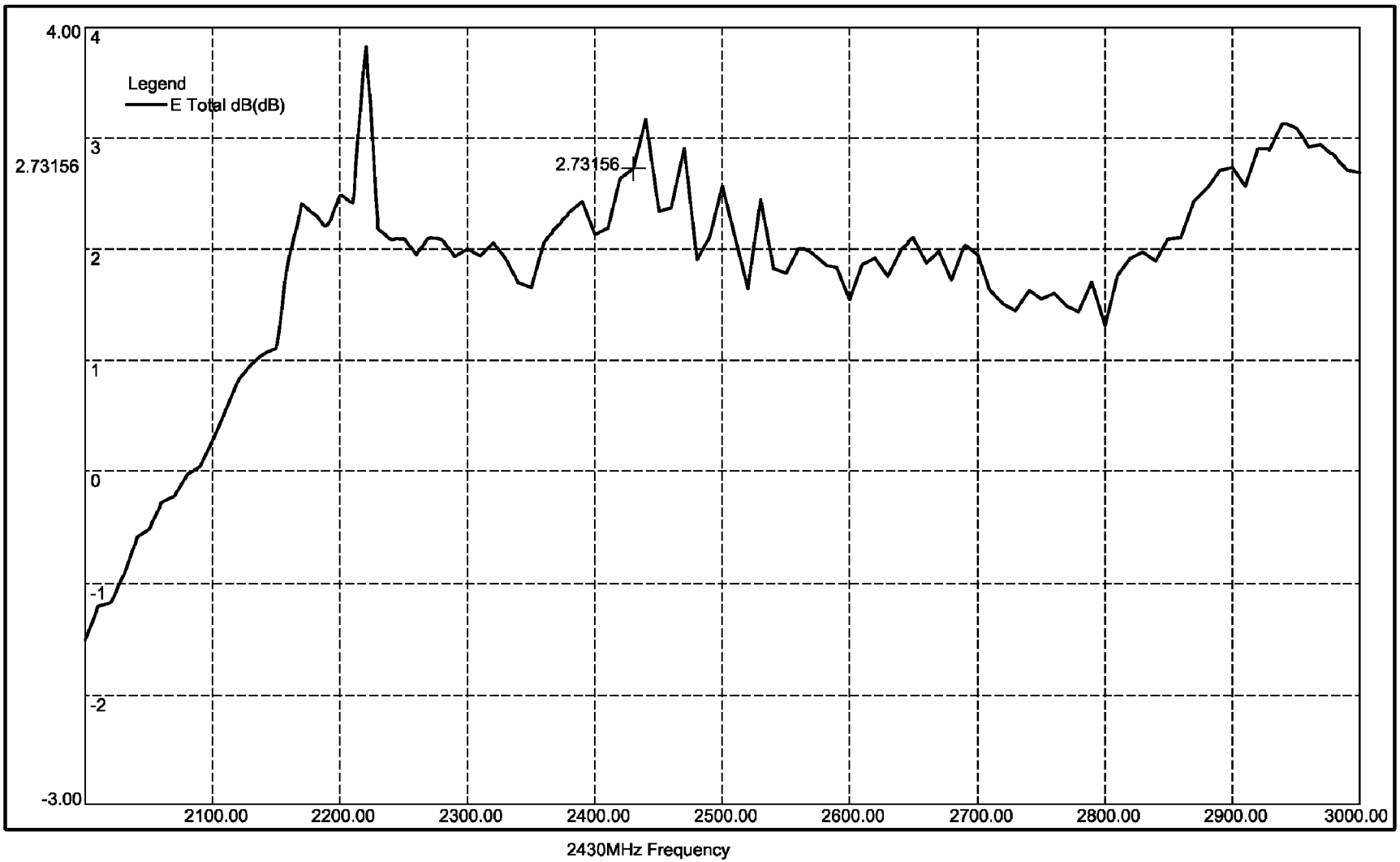
FIG. 7 is a view showing the peak gain of the sheet-like dipole antenna of the present invention.

Please refer to FIG. 7, which is a view showing the peak gain of the sheet-like dipole antenna of the present invention. As shown in this figure, the peak gain of the sheet-like dipole antenna of the present invention is 2.73 dBi when the frequency is 2430 MHz.

Figure 8:
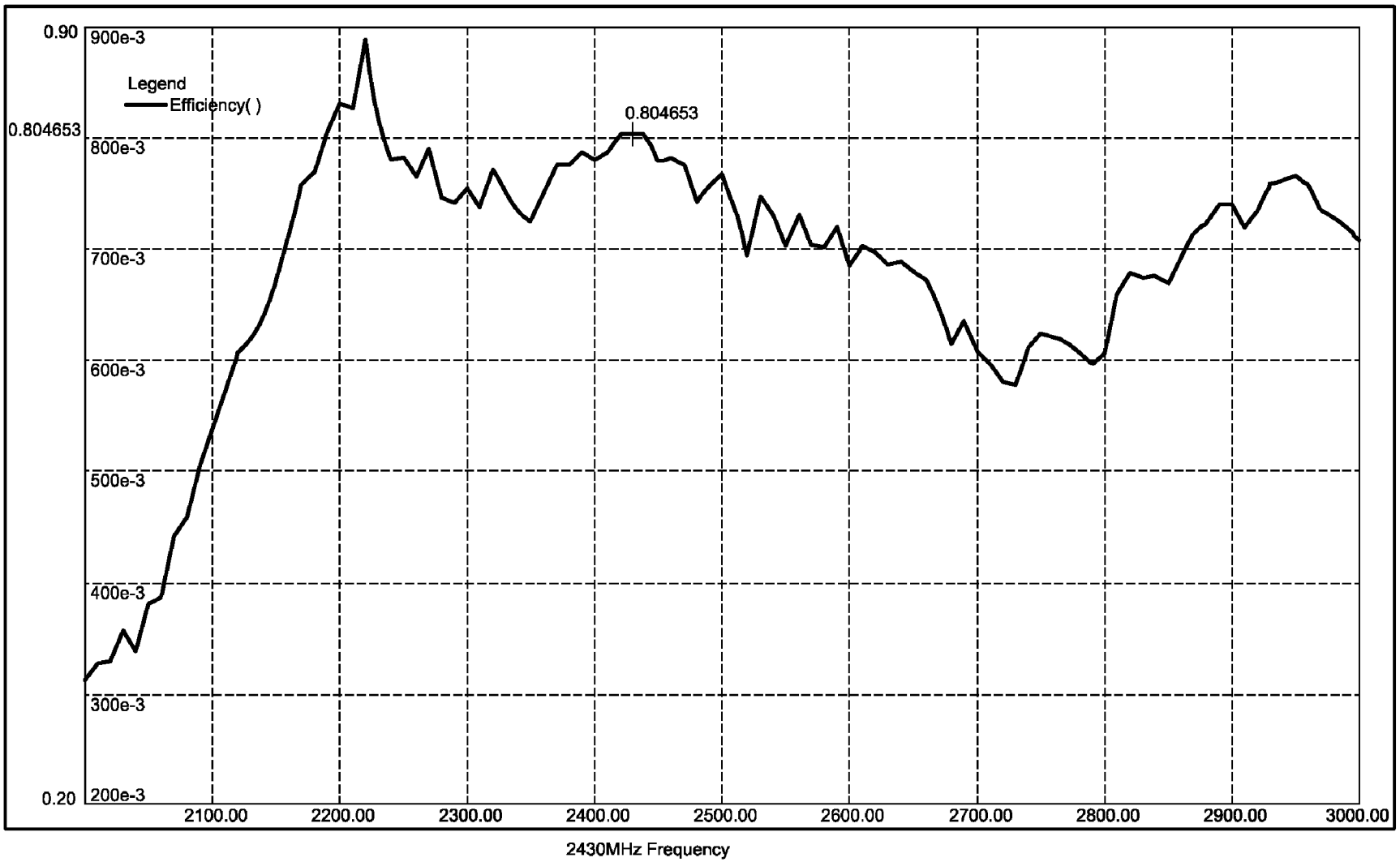
FIG. 8 is a view showing the efficiency of the sheet-like dipole antenna of the present invention.

Please refer to FIG. 8, which is a view showing the efficiency of the sheet-like dipole antenna of the present invention. As shown in this figure, the efficiency of the sheet-like dipole antenna of the present invention is 80.46% when the frequency is 2430 MHz.

Figure 9:
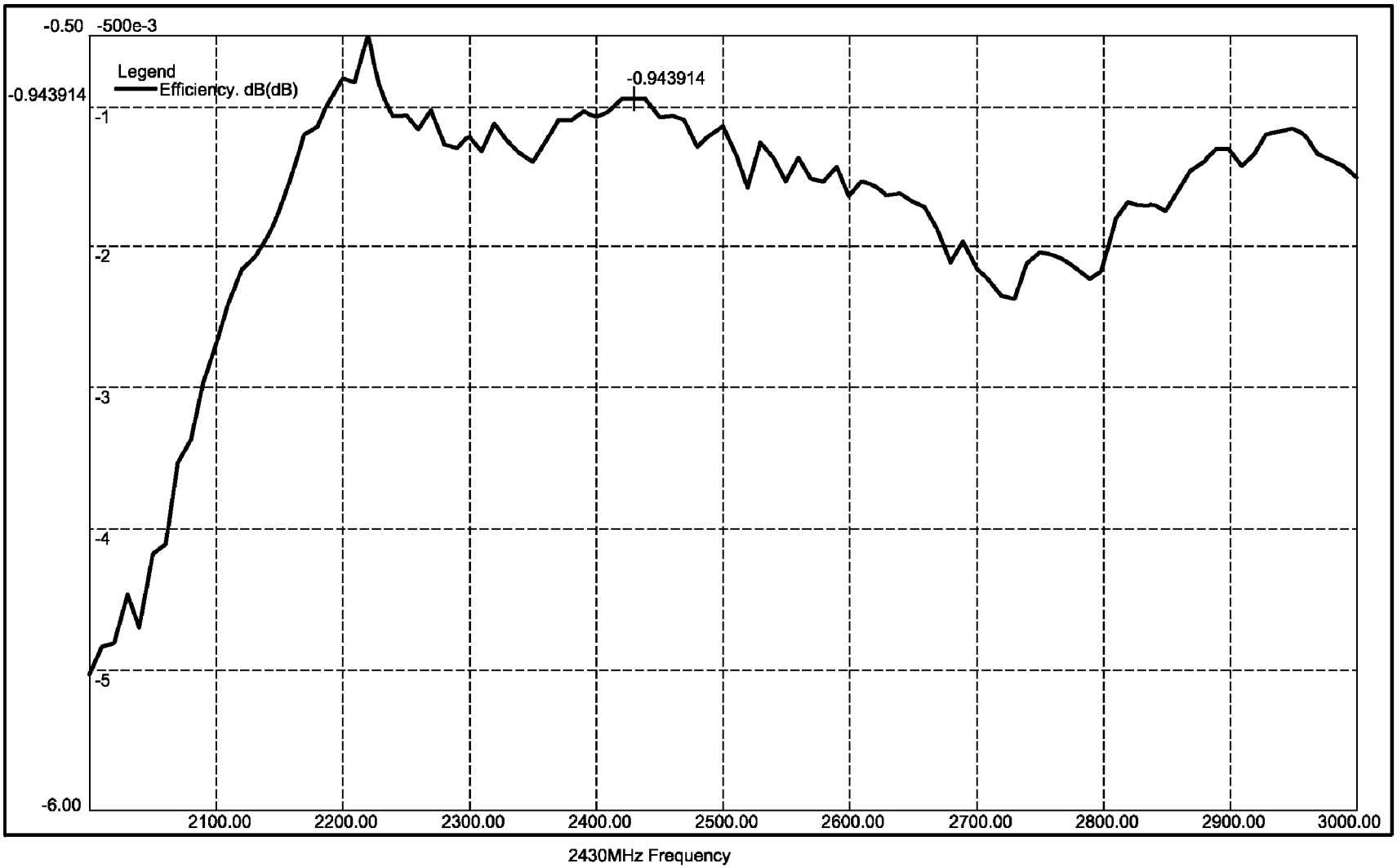
FIG. 9 is a view showing the average gain of the sheet-like dipole antenna of the present invention.

Please refer to FIG. 9, which is a view showing the average gain of the sheet-like dipole antenna of the present invention. As shown in this figure, the average gain of the sheet-like dipole antenna of the present invention is −0.94 dBi when the frequency is 2430 MHz.

Figure 10A:
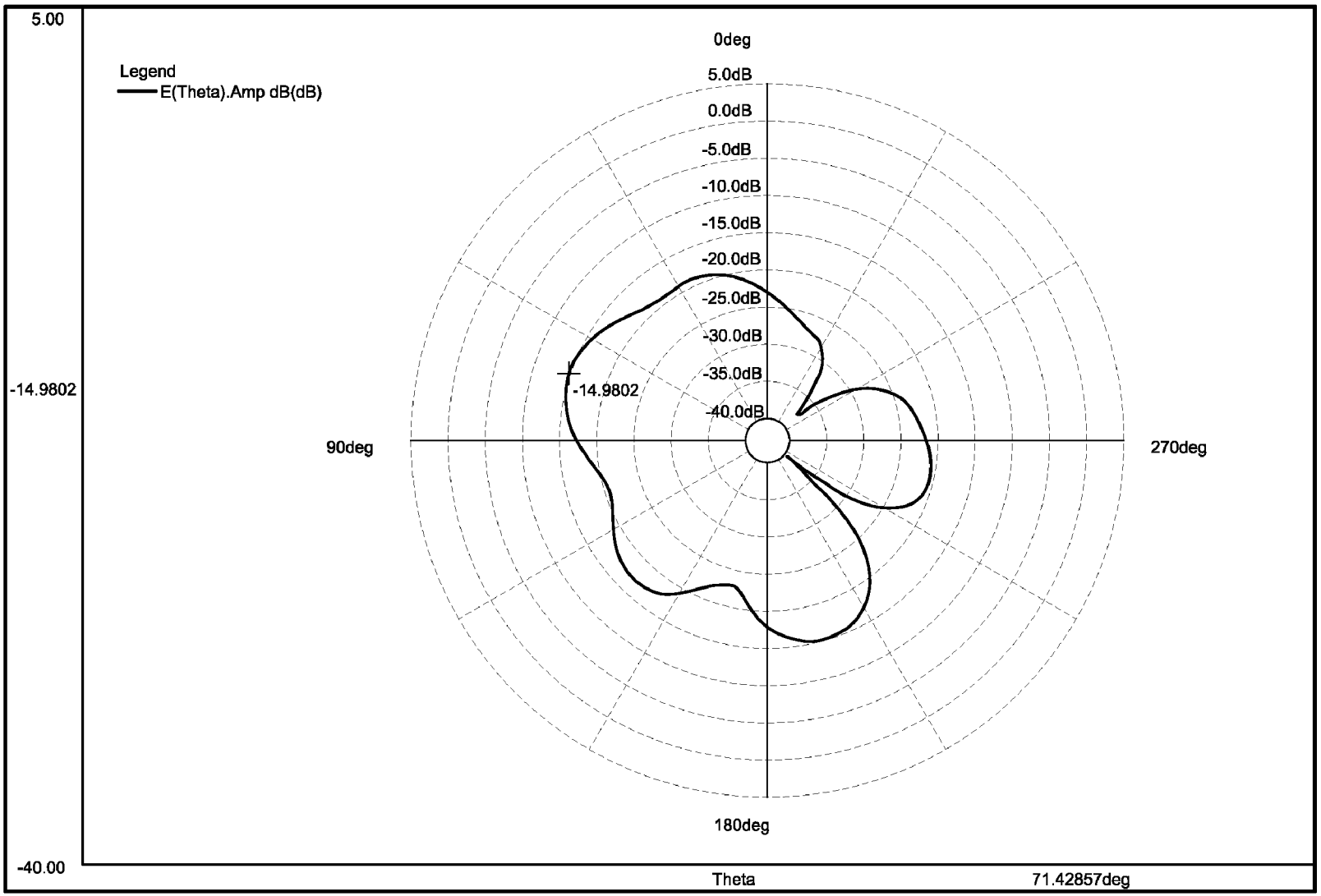
FIGS. 10A and 10B are views showing the radiation direction of the antenna of the present invention.
Figure 10B:
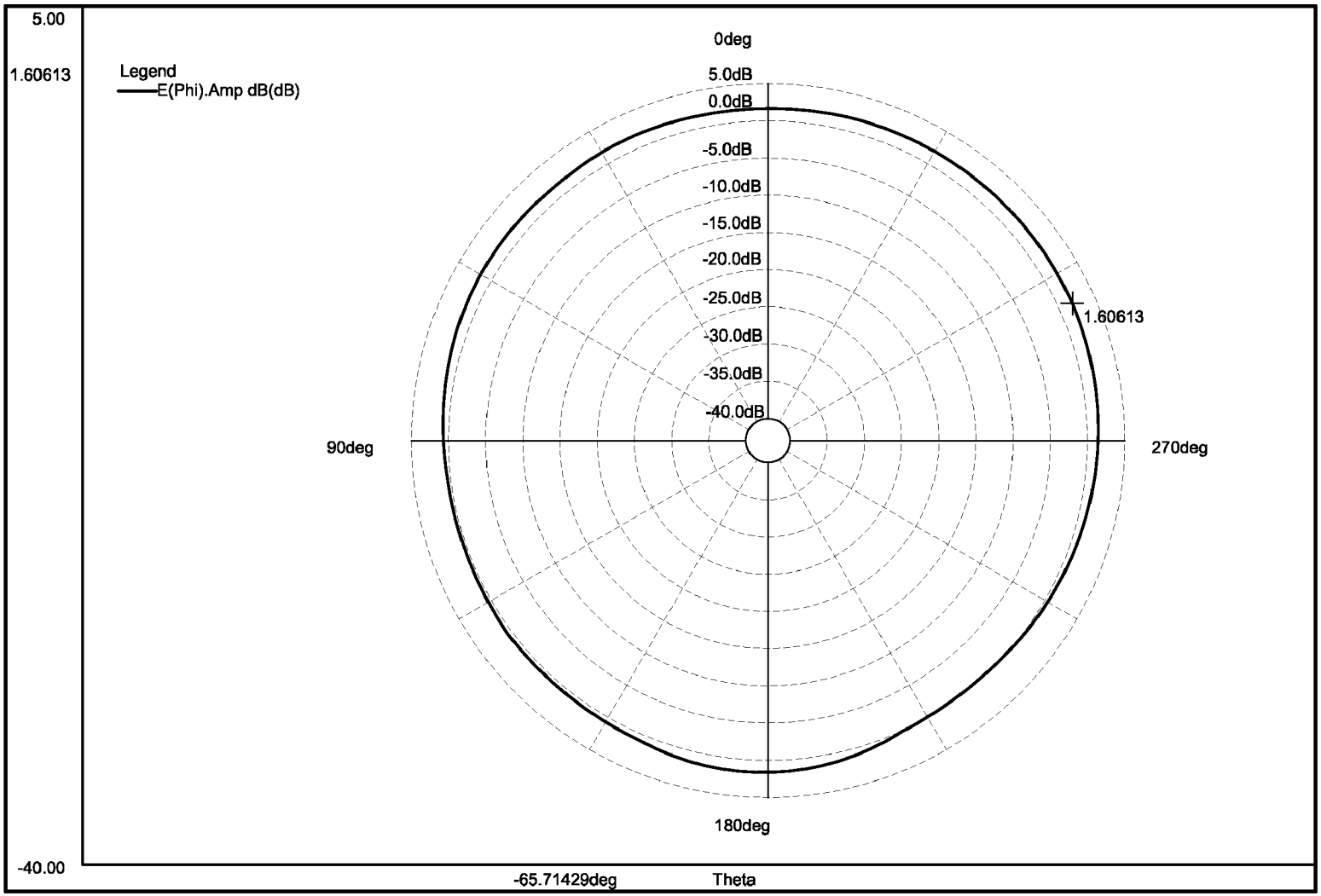

Please refer to FIGS. 10A and 10B, which are views showing the radiation direction of the antenna of the present invention. As shown in these figures, in the X-Z plane, the horizontal maximum gain is −14.98 dB and the vertical maximum gain is 1.60 dB when the frequency is 2400 MHz.

Figure 11A:
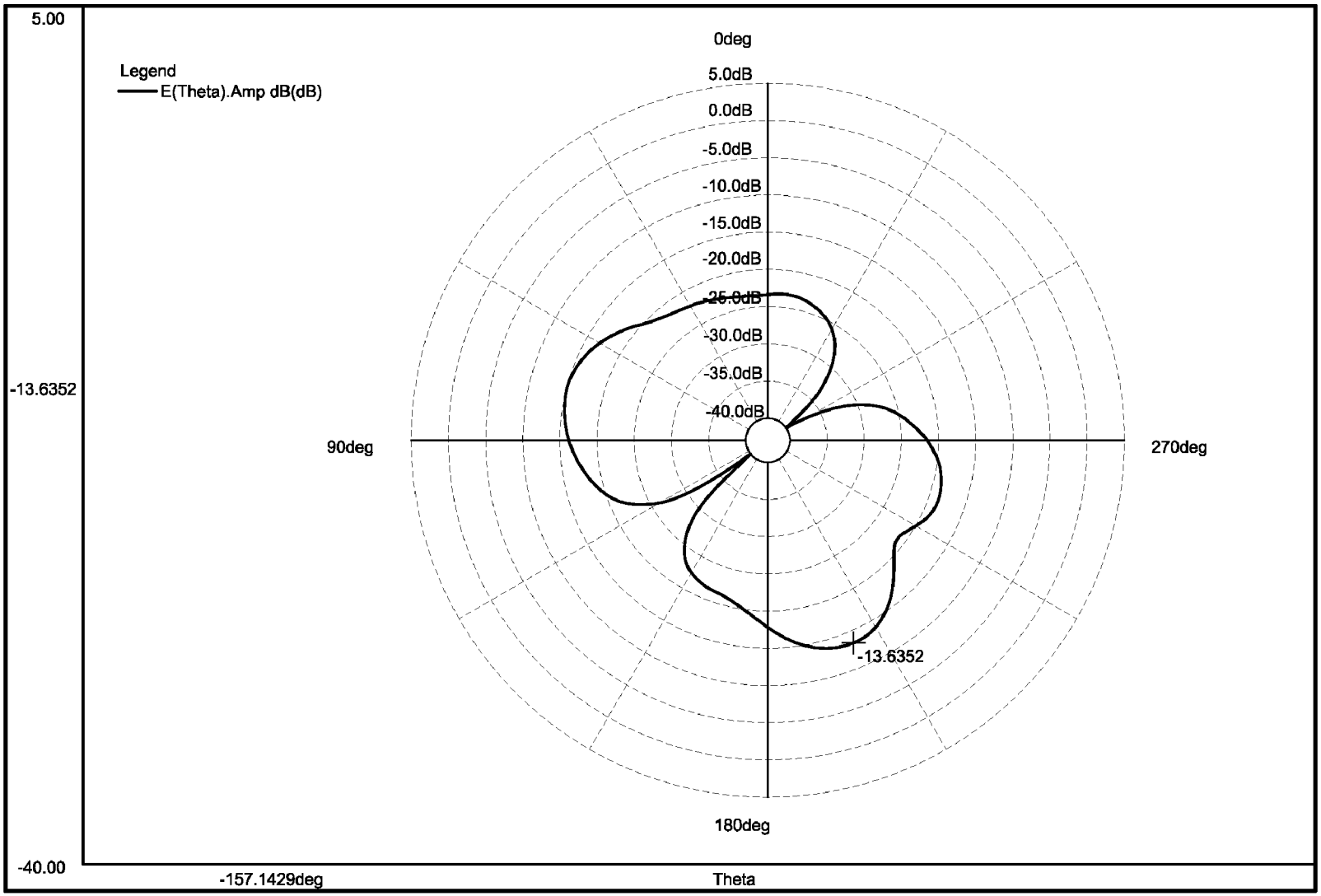
FIGS. 11A and 11B are views showing the radiation direction of the antenna of the present invention.
Figure 11B:
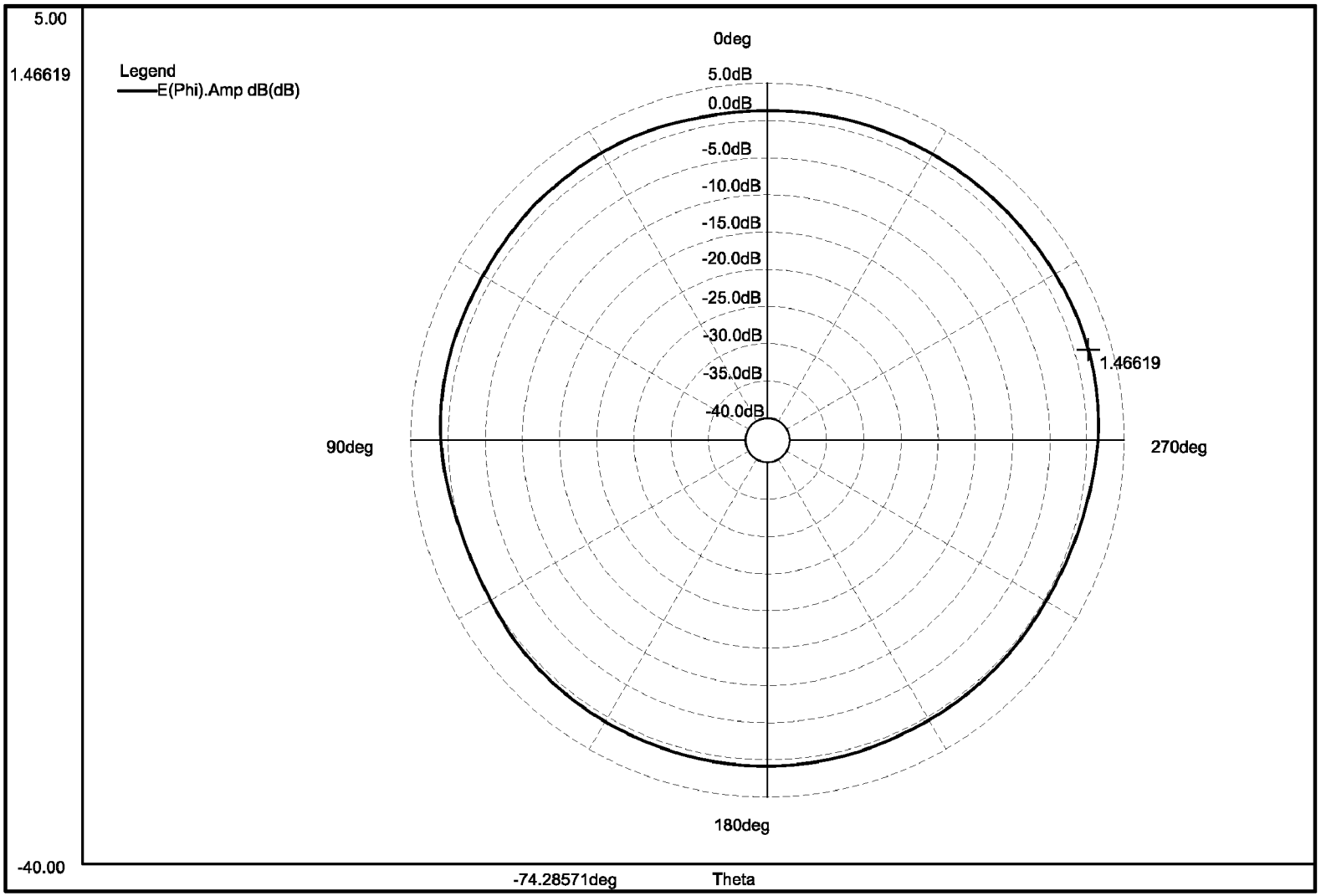

Please refer to FIGS. 11A and 11B, which are views showing the radiation direction of the antenna of the present invention. As shown in these figures, in the X-Z plane, the horizontal maximum gain is −13.63 dB and the vertical maximum gain is 1.46 dB when the frequency is 2450 MHz.

Figure 12A:
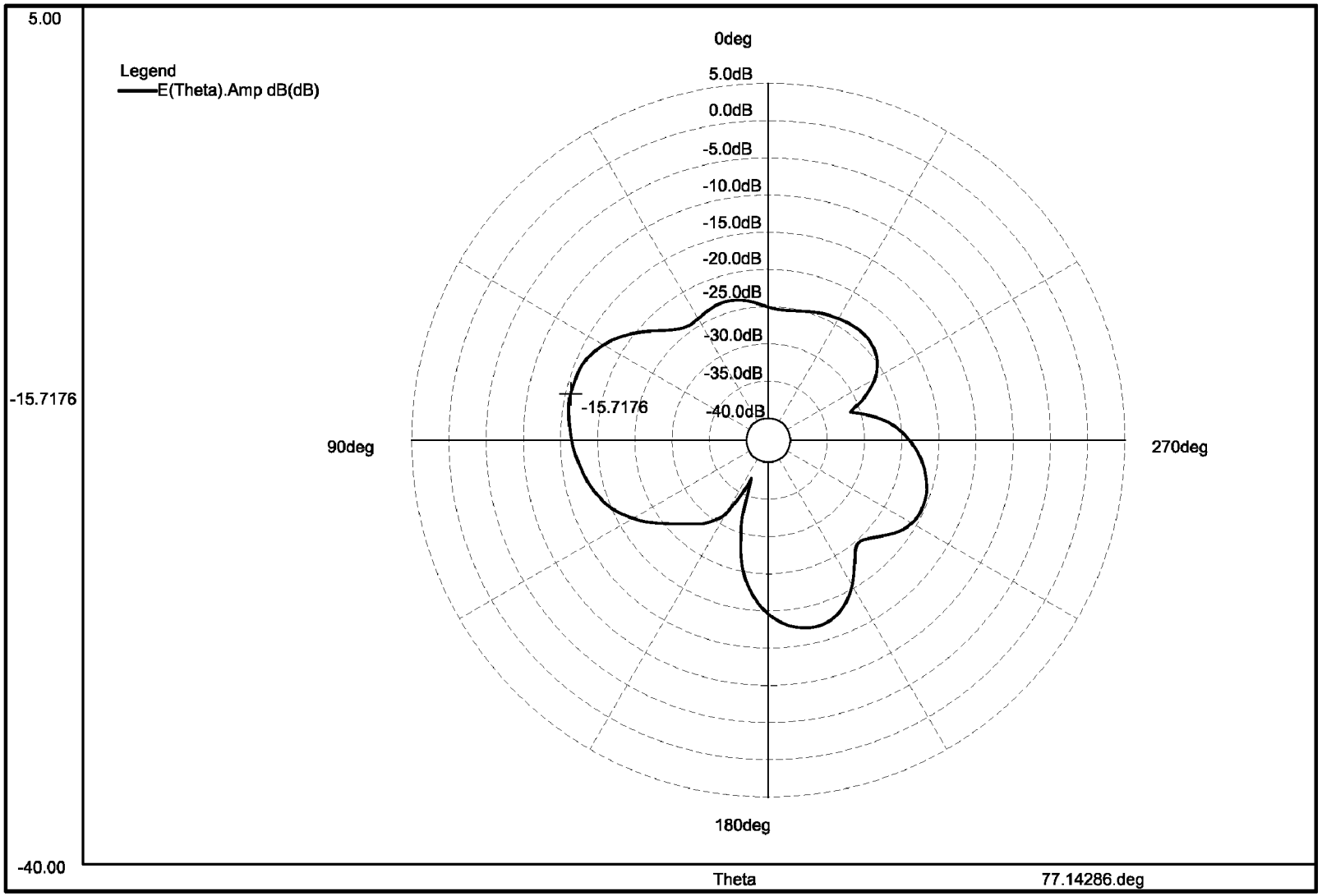
FIGS. 12A and 12B are views showing the radiation direction of the antenna of the present invention.
Figure 12B:
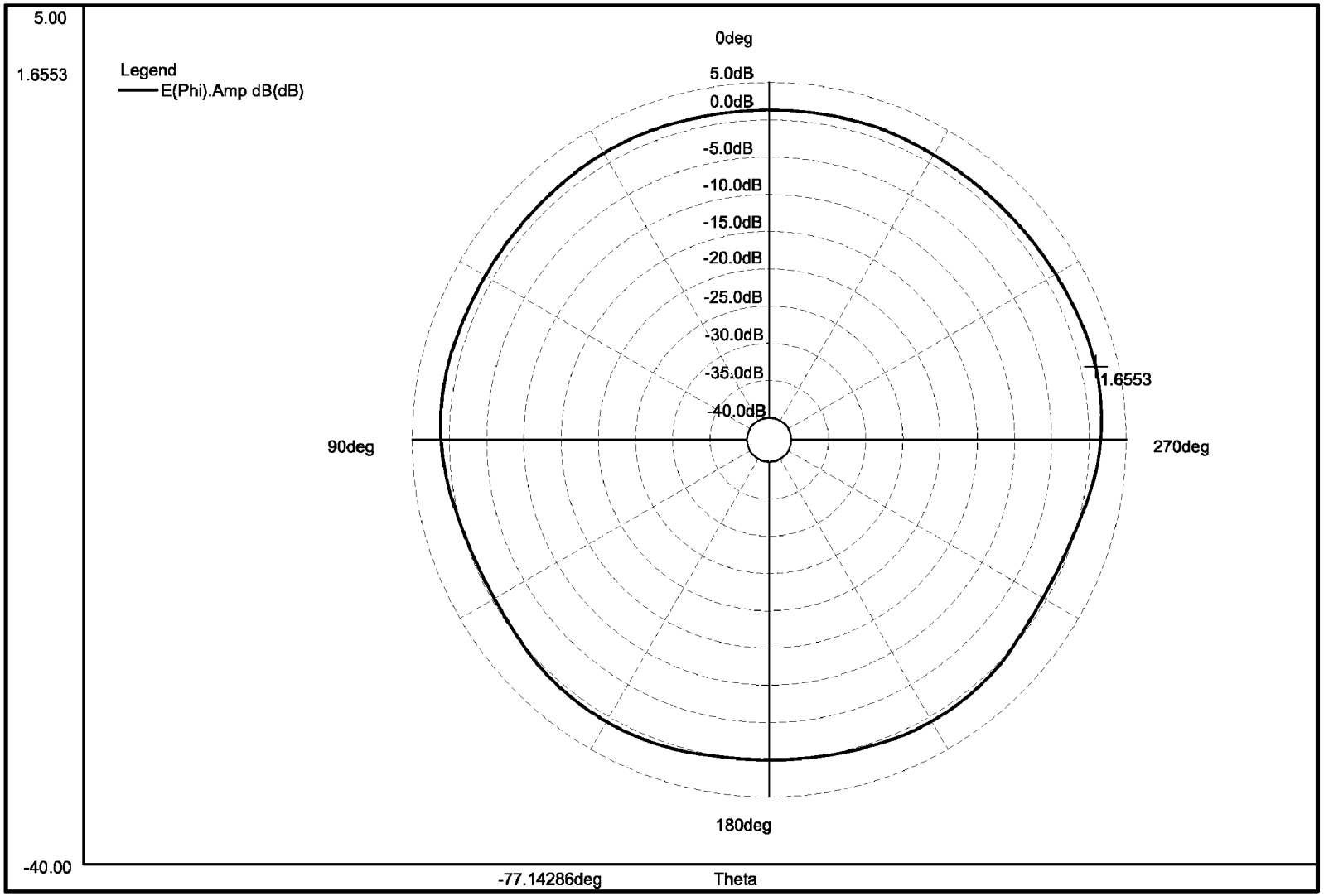

Please refer to FIGS. 12A and 12B, which are views showing the radiation directions of the antenna of the present invention. As shown in these figures, in the X-Z plane, the horizontal maximum gain is −15.71 dB and the vertical maximum gain is 1.65 dB when the frequency is 2500 MHz.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A sheet-like dipole antenna, mounted within an electronic product and including:

a substrate (1) having a copper clad surface (11), the copper clad surface (11) having a slot (12) constituted of a short-strip section (12*a*), a rectangular section (12*b*), and a long-strip section (12*c*), an insulating film (13) being provided on the copper clad surface (11) and the slot (12), a rectangular first soldering region (14) uncovered by the insulating film (13) being formed on the copper clad surface (11) in front and rear of the rectangular section (12*b*) of the slot (12) respectively, a squared second soldering region (15) uncovered by the insulating film (13) being formed on the copper clad surface (11) to connect to one side of the first soldering region (14), one side of the second soldering region (15) being connected to the long-strip section (12*c*) of the slot (12), a squared third soldering region (16) uncovered by the insulating film (13) being formed on the copper clad surface (11) to connect to the other side of the long-strip section (12*c*) of the slot (12); and an F-shape antenna (2) having a carrier (21), a top surface of the carrier (21) having a radiation metallic surface (22), the radiation metallic surface (22) having an input pin (23) and a grounding short-circuit pin (24) extending to one side of the carrier (21), the F-shape antenna (2) being soldered to both of the first soldering regions (14) with the input pin (23) electrically connected to the second soldering region (15).

2. The sheet-like dipole antenna according to claim 1, wherein a length L of the copper clad surface (11) is in a range from one-fourth to three-fourth of the wavelength, and its width W is larger than one-eighth of the wavelength.

3. The sheet-like dipole antenna according to claim 2, wherein the third soldering region (16) and the second soldering region (15) are located opposite to each other in a diagonal direction.

4. The sheet-like dipole antenna according to claim 1, wherein the carrier (21) is made of high dielectric constant materials.

5. The sheet-like dipole antenna according to claim 1, wherein the carrier (21) is configured as a metallic conductor, so that copper clad lines on both ends of the first soldering region (14) are electrically connected to each other.

6. The sheet-like dipole antenna according to claim 1, further including a cable (3) with a core (31), the core (31) being coated by an insulating layer (32), the insulating layer (32) being coated by a grounding layer (33), the grounding layer (33) being coated by an outer skin (34), one end of the cable (3) being electrically connected to a connector (35).

7. The sheet-like dipole antenna according to claim 6, wherein the core (31) is connected to the second soldering region (15), and the grounding layer (33) is soldered to the third soldering region (16).

* * * * *